US005434556A

United States Patent [19]

Donohoo

[11] Patent Number: 5,434,556

[45] Date of Patent: Jul. 18, 1995

[54] MAGNETIC DOOR ALARM WITH RESETTABLE DELAY

[76] Inventor: Daniel J. Donohoo, 3175 Hafner Ct., St. Paul, Minn. 55126

[21] Appl. No.: 180,439

[22] Filed: Jan. 12, 1994

[51] Int. Cl.[6] ..... G08B 13/08

[52] U.S. Cl. ..... 340/547; 340/528; 340/636

[58] Field of Search ..... 340/547, 546, 545, 636, 340/528

[56] References Cited

U.S. PATENT DOCUMENTS

| | | | |
|---|---|---|---|
| 4,004,288 | 1/1977 | Webb, Jr. | 340/636 |
| 4,278,968 | 7/1981 | Arnett et al. | 340/545 |
| 4,335,376 | 6/1982 | Marquardt | 340/547 |
| 4,427,975 | 1/1984 | Kinzie | 340/547 |
| 4,920,333 | 4/1990 | Barr et al. | 340/545 |
| 5,138,299 | 8/1992 | Patten et al. | 340/545 |
| 5,144,283 | 9/1992 | Arens et al. | 340/546 |

*Primary Examiner*—Glen Swann

[57] ABSTRACT

A battery alarm system that is capable of recognizing when a child has opened a door by utilizing self contained electronic circuitry with a switch mounted out of reach of the child. If a child opens the door, the horn sounds. If a taller person opens the door, he can prevent the sounding of the alarm by pressing the switch either before or after the door is opened and then closing the door within a preset time. The preset time period may be extended by pressing the button. If the horn has sounded and the button is pressed, closing the door will shut off the horn. The door can also be opened and closed and the switch pressed all within a preset time without the horn being sounded. These features avoid the horn being unnecessarily sounded. When the battery energy is depleted, the horn emits a chirping sound for several weeks. The electronic circuitry allows for very low power drain and permits the battery to last for over a year under normal operating conditions. The switch, horn, and electronic circuitry are mounted near a door with leads from the electronic circuitry to a magnetic reed mounted on the door jam. The magnet that mounts to the door next to the reed switch activates and deactivates the reed switch.

9 Claims, 2 Drawing Sheets

MAGNETIC DOOR ALARM WITH RESETTABLE DELAY

BACKGROUND—FIELD OF INVENTION

This invention relates to self contained door alarm systems, specifically for doors that enter into an area containing a swimming pool.

BACKGROUND—DESCRIPTION OF PRIOR ART

Each year many children die or suffer permanent brain damage due to drowning in backyard pools. It is one of the leading causes of death of young children in some of the southern states in this country. The ratio of body surface area to body volume is much higher in a small child. Thus a child in a pool will lose his body heat much quicker. Also, the volume of blood in a child is much less and does not have the oxygen carrying capability that a larger person has. Thus, reports from medical personnel who attend to young drowning victims say that after two minutes in a pool, brain damage begins. This contrasts with adults who have survived up to twenty five minutes without any long term effects. There are children in hospitals who have been deserted by their parents since they are hopelessly brain damaged. Also, the divorce rate of parents suffering a pool drowning is twice the normal rate.

It is imperative that children do not have access to a pool area without a responsible person present. Many localities have building codes that require fencing around a pool with a secure gate lock. However, many pools have as the fourth side of the fence the house which has one or more entrances to the pool area. These entrances are sometimes left open or easy to open by children and thus the young child can crawl or walk out these entrances into the pool area unattended and unknown. An easy to use door alarm system can prevent these entrances from being unprotected.

One system on the market provides an alarm for this application. It is called POOL GUARD TM and is manufactured and sold by PBM industries located in North Vernon, Ind. That system utilizes a normally open door sensor, as opposed to a normally closed door sensor. The normally open door sensor is considered less reliable and is not fail safe; a broken wire to the magnetic reed sensor renders the system inoperative. The user would have no knowledge of this unless he checked his unit on a very frequent basis.

Another disadvantage of Pool Guard TM is the users of the system must be very structured in its use in order to avoid inadvertant alarms. To exit, one must first open the door and then press the button within four seconds. If one does not meet this deadline, then the horn is activated fifteen seconds after the door was opened. At this time the exiting person is outside the door and must reenter and push the button to deactivate the false horn alarm. This is most inconvenient to the exiting person and to any persons inside who would also be annoyed by the false alarm.

Another disadvantage occurs if one takes too much time exiting even though the button has been pressed. The horn is now activated. Closing the door will not deactivate the horn. One must reenter and press the button and reexit to deactivate the false horn alarm.

Another disadvantage of the Pool Guard TM system is that it has no circuitry alerting the user to a low battery condition. Without an alert, one would not know that the battery is low jeopardizing the operation of the system. The importance of this feature is recognized by its utilization in home smoke and fire detector alarms.

A patent search revealed several patents that have an alarm system with delay. U.S. Pat. No. 5,138,299 to Patten et al. requires one to push the switch prior to opening the door to avoid the sounding of the horn. The disadvantage of this system is that not only is one required to remember to push the button first but more importantly one can not enter from the outside without the alarm sounding, for he must first open the door and only then is the button available for pushing. Further, the Patten system permits only one extension of the time period whereas a pool alarm system would require a resettable time period to allow longer door openings as sometimes required.

U.S. Pat. No. 4,278,968 to Arnett et al. provides for alarm condition whenever a door has been opened beyond a predetermined time. A pool alarm system requires a activation whenever a door has been opened for any length of time.

OBJECTS AND ADVANTAGES

U.S. Pat. No. 4,004,288 to Webb, Jr. discloses a voltage detection circuit using a zener diode for announcing a low battery condition, which circuit demands much higher current draw than the diode circuit used in my invention. Further, the wider tolerance of the zener diode requires a potentiometer for adjustment, which is not required in my invention.

U.S. Pat. No. 4,335,376 to Marquardt senses a door opening but does not monitor the door if the door stays opens. The time delays in the Marquardt patent pertain to entry and exit time and a minimum on time to detect an intruder. The Marquardt patent would not protect a child since the door could stay open without an alarm being activated.

U.S. Pat. No. 4,427,975 to Kinzie monitors the unauthorized opening of a door. It does not provide for an alarm to protect a child if a door is left open.

U.S. Pat. No. 4,920,333 to Barr et al senses a door opening through a deadbolt. The deadbolt decides if the entry is authorized or unauthorized. This does not protect the child who wanders through a unlocked door.

U.S. Pat. No. 5,144,283 to Arens et al does not have the necessary resettable and time delay functions. The delays for entry and exit are fixed and the system is not suitable as a door alarm described in this application.

Accordingly several objects and advantages of my invention are to provide a self contained alarm system that will sound when a child opens the door and yet easy to install and use, and yet avoids false alarms. A system fraught with false alarms will be disabled or ignored by the user no matter what the requirements of the local building codes.

My invention utilizes a normally closed door sensor when in the presence of a magnet. The alarm will sound if the leads from the electronic circuitry to the magnetic reed is interrupted.

In utilizing my door alarm system, one may press the button before or after opening the door. The is essential in avoiding false alarms when one is returning to the house.

If one has pressed the button, and the alarm has sounded for whatever reason, closing the door will deactivate the alarm.

My invention has circuitry for detecting the battery when the battery is near the end of its life. A chirp for one half second every minute for a two week period alerts the user to this condition.

My invention provides for a resettable time period each time the switch is pressed.

With all the provisions listed above, the unit is about as user friendly as possible. There are no surprises about the operation of this door alarm system. The horn will not sound when exiting the house by pressing the switch before or after opening the door and then closing the door. The horn will not sound when entering the house by opening the door, pressing the switch and closing the door.

While all these features make it easy for adults or taller people to use, the unit is always on its mission protecting the young children. Anytime the door is opened and the button is NOT pressed, the horn will always go off.

DRAWING FIGURES

DESCRIPTION OF INVENTION

Figure 1:
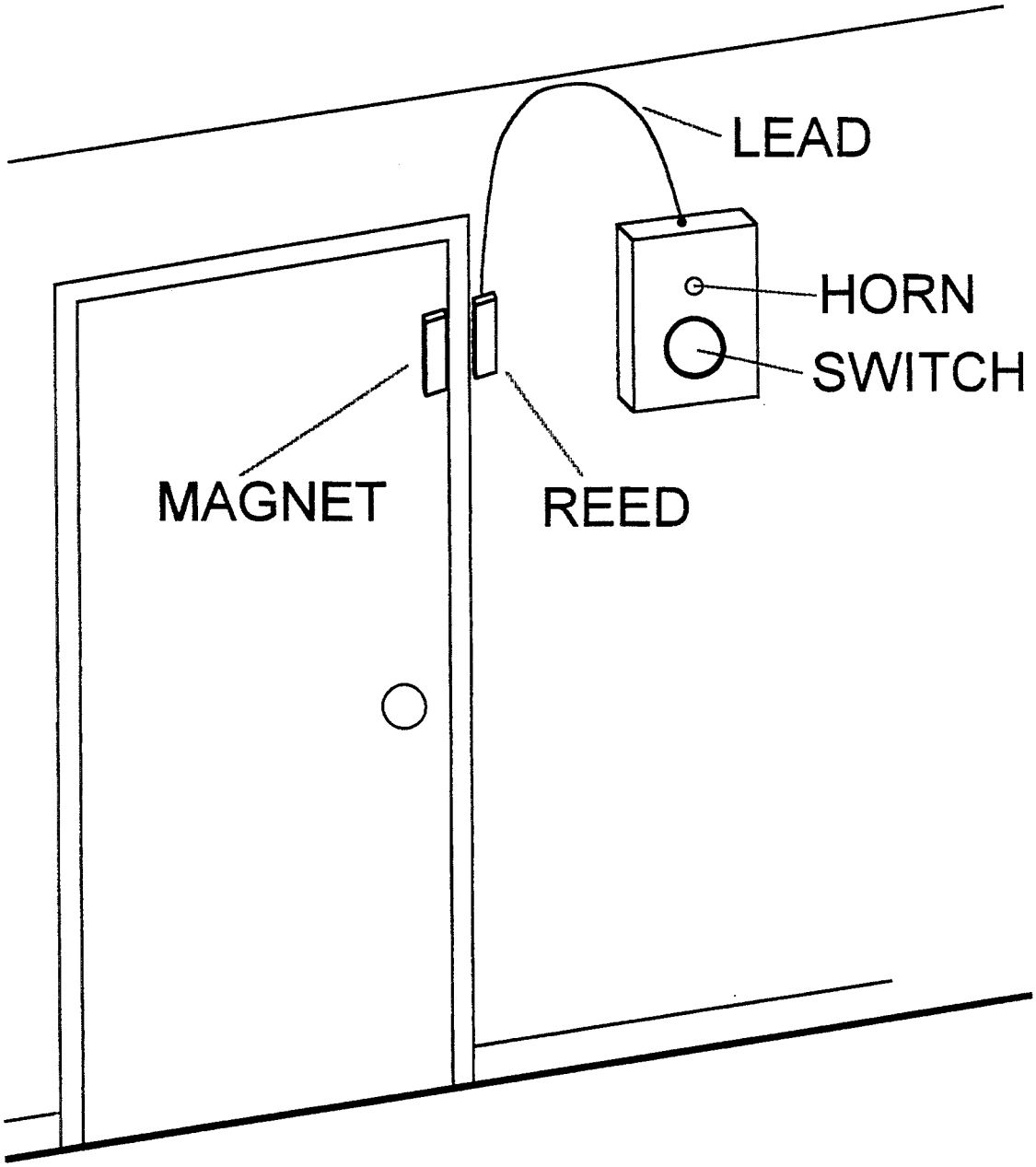
FIG. 1 shows the placement of the door alarm system, comprising the magnet mounted on the door, the reed mounted in close proximity to the magnet on the door jamb, and the unit mounted on the wall containing the battery, electronic circuitry, switch and horn.
Figure 2:
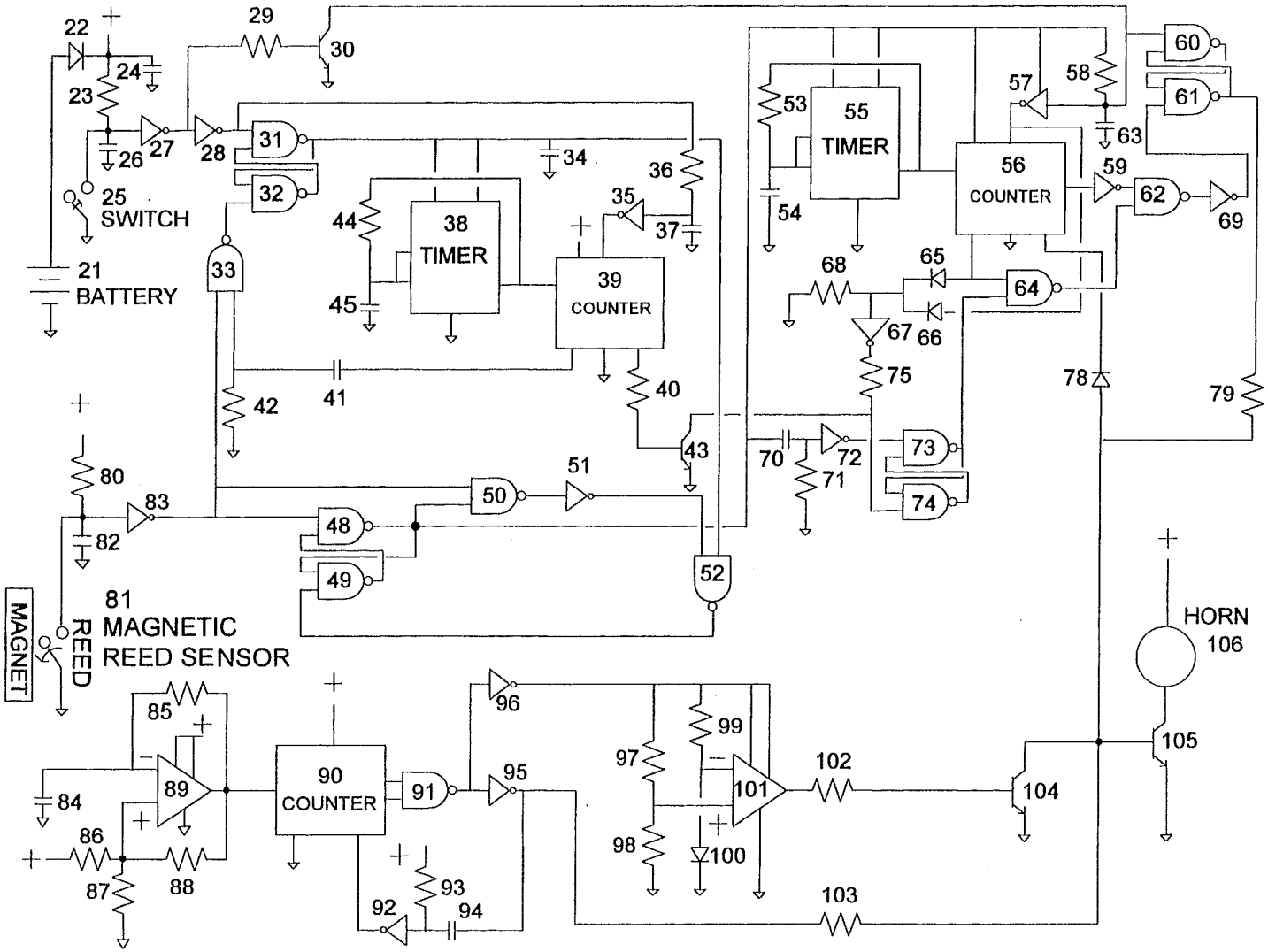
FIG. 2 shows the schematic of the electronic circuitry.

A discussion of FIG. 2 shows how the circuit performs the specifications of the door alarm system.

The power source is a 9 volt battery 21. Since most of the logic and timing circuits are of the CMOS variety, very small amounts of current are drawn. Also op amp 89 which is a TLC271 draws only 5 microamperes. Timer oscillators 55 and 38 draw 180 microamperes each if continuously supplied with power. However, both of these circuits are only powered up when turned on by the output of a CMOS gate. Only when the circuit is in use, do these timer oscillators draw current. The circuitry typically draws 9 microamps during standby. A nine volt battery has 450 milliamp-hours of charge. The standby charge for a year requires about 80 milliamp hours. The horn takes about 25 milliamperes. If the horn is on for an unlikely one hour per year, it would require 25 milliampere-hours. Thus, the battery should last well over a year even if the sensing circuit starts chirping at 7 volts which is the point that one-half of the battery life is still left. This assumes the horn goes off a limited number of times and never left running. This should be realized since operation of the unit is very simple and the horn is never left running when a person exits the building having pushed the button. Since the closed door prevents the horn from being actuated, the horn will not turn on when it cannot be heard.

The low battery detection is described as follows. Op amp 89 is a low power op amp which serves as an oscillator for chip 90 which is an industry standard 4020 counter chip. With capacitor 84 equal to 0.001 microfarad, resistor 86 equal to 22 megohms, resistor 87 equal 1 megohms, resistor 88 equal to 220 kiloohms and resistor 85 equal to 6.8 megohms, the period of oscillation is approximately 45 milliseconds at voltages from 6 to 9 volts from the battery. This frequency is fed to chip 90. Two outputs of chip 90 go to NAND gate 91. The output of 91 goes to CMOS inverters 95 and 96. Resistor 93 equal to 10 kiloohms and capacitor 94 equal to 0.001 microfarad comprise a pulse shaping network fed into CMOS inverter 92 which go to the reset line on 90. The two outputs of counter 90 are Q4 and Q11. When both of these outputs go high, they provide a reset signal to the counter 90. This resets the counter and provides a pulse of 360 milliseconds which occurs every 46 seconds. This pulse occurs at the output of inverter 96 which drives op amp 101 and resistors 97, 98 and 99 and diode 100. These four components determine if op amp output is high or low depending on the battery supply. If the output is high transistor 104 is turned on through resistor 102. The saturation voltage of this transistor is lower than the turn on voltage of transistor 105. Thus even though inverter 95 is high during this time, it is incapable of turning on transistor 105 through resistor 103.

The battery supplies voltage through diode 22. This protects the circuitry from reverse polarity. Capacitor 24 provides transient power during switching of the logic. Switch 25 through inverters 27 and 28 sets the flip-flop consisting of 31 and 32. A capacitor 34 stabilizes the output of 31. This flip-flop supplies power to the timer circuit 38, resistor 44, and capacitor 45 which outputs to counter 39 which is a 4020B. This creates the window of time that the button can be pressed before the door is opened to keep from actuating the horn. The Q12 output of counter 39 will reset the flip flop 31 and 32 through capacitor 41 and resistor 42 and NAND gate 33 if the reed is open. The reed switch through inverter 83 sets flip-flop 48 and 49 which supplies voltage to circuits 55, 56, 57, 60, 61, 59, 62, 69, 64, 67, 72, 73, and 74. This is the timing circuit that generates either the seven or fifteen seconds time delays. Transistor 43 is turned on and off by counter 39. This frequency oscillation keeps flip-flop 73 and 74 from staying set. Circuits 57 and 35 make sure the counters are cleared when voltage is applied. Resistor 36 and capacitor 37 provide this reset pulse for counter 39 whenever the switch 25 is actuated. Resistor 23 and capacitor 26 serve to debounce the switch. The switch 25 also enables transistor 30 through resistor 29 to provide a high reset signal to counter 56. Resistor 58 and capacitor 63 provide a pulse to 57 to reset counter 56 whenever the supply goes high.

Resistor 53 and capacitor 54 with timer 55 provide the clock for the 7 and 15 second delay. Diode 65 and 66 provide a coupling path and by using resistor 68 and 75 and inverter 67 to provide a reset for flip-flop 73 and 74. Flip-Flop 60 and 61 provide a latch for turning on the horn 106 through resistor 79. Diode 78 provides for the pulsing of the horn by connecting to the Q9 output of the counter 56. Capacitor 70 and resistor 71 with inverter 72 reset flip-flop 73 and 74 whenever the voltage goes high. Additionally the Q1 output drives transistor 43 through resistor 40 to keep the flip-flops 73 and 74 reset.

The magnet reed sensor S1 activates inverter 83 with resistor 80 and capacitor 82 serving as a debouncing switch. In both debouncing circuits, the capacitors also serve to supply a high inrush current to keep the contacts clean. Gates 50, 51, and 52 reset flip-flop 48 and 49 whenever the time delay has expired and the reed switch is closed.

Timers 38 and 55 are TLC 555 integrated circuits manufactured by Texas Instruments. Counters 39, 56 and 90 are 4020B manufactured by RCA.

Operation

The door alarm system is installed by mounting the unit containing the horn, switch, and electronic circuitry near the opening of the door. The magnet, one of the two elements of the magnetic reed switch, is mounted on the door. The other element, the reed, is mounted in close proximity on the door jamb.

The door alarm system is operated as follows:

(a) The alarm button can be pressed for a time period before or after the door is opened. This time is set at five seconds but can be easily changed in the design. Once the door is opened one has fifteen seconds to close the door before the horn is activated.

(b) If the fifteen seconds is not sufficient time to get the door closed, pressing the switch momentarily will give the user another fifteen seconds. This can be repeated as many times as desirable or the button can be held down whereas the timing cycle commences when the button is released.

(c) If the door is opened for longer than the fifteen seconds which activates the horn, pressing the switch momentarily turns off the horn and allows for the door to be opened for another fifteen seconds before the horn would be activated again.

(d) In all cases, whenever the door is closed and as long as the button has been pressed, the horn will be turned off automatically. It is not necessary to press the button after the door is closed to deactivate the horn or to keep the horn from being activated.

(e) If the voltage from the readily available 9 volt battery approaches the end of its service life, a short chirp is heard from the unit approximately every minute for a period of at least two weeks.

(f) If the lead from the electronic circuitry is interrupted, the alarm will sound announcing the failure.

Summary, Ramifications, and Scope

Thus, the reader will see that the door alarm system of the invention provides a reliable, easy to install, and easy to use alarm system that will sound a alarm when a child opens the door and yet avoids false alarms.

While my above description contains many specifications, these should not be construed as limitation on the scope of the invention, but rather as an exemplification of one preferred embodiment thereof. Many other variations are possible. For example another variation would be the use of the invention in industrial buildings for security purposes. Accordingly, the scope of the invention should be determined not by the embodiment illustrated, but by the appended claims and their legal equivalents.

I claim:

1. An alarm system comprising a proximity switch responsive to the opening of a door to produce an energizing signal;

a user actable switch;

an electrical power source;

an alarm means responsive to said energizing signal to provide a perceptible alarm signal; and a timer and logic means for generating a plurality of time periods for disabling said alarm signal, one of which allows a time period after actuation of said user actuable switch before opening said door to activate said proximity switch during which activation of said alarm means is prevented for a predetermined period, another of which allows a time period after opening said door to activate said proximity switch during which activation of said user actuable switch prevents activation of said alarm means for a predetermined period, another of which allows an extension of the period during which activation of said alarm means is prevented after the alarm means has been energized and then disabled by said user actable switch, and another of which allows for an extension of the period during which activation of said alarm means is prevented before the alarm means is energized.

2. The alarm system of claim 1 further comprising an electronic circuit comprised of a means to activate the alarm means if the lead between the electronic circuit and the proximity switch is interrupted.

3. The alarm system of claim 1 further comprising an electronic circuit with a means to activate the alarm means with a chirping sound for an extended period of time when the energy of the power source is low.

4. The alarm system of claim 1 wherein the proximity switch comprises a magnetic reed switch.

5. The alarm system of claim 1 wherein the electrical power source comprises a battery.

6. An alarm system comprising:

a proximity switch responsive to the opening and closing of a door;

a user actable switch;

an electrical power source;

an alarm means responsive to an energizing signal to provide a perceptible alarm signal;

an electronic circuit comprised of a means to activate the alarm means if the proximity sensor senses the door's opening without the actable switch's being pressed within a predetermined length of time;

an electronic circuit comprised of a means to activate the alarm means if a lead between the electronic circuit and the proximity switch is interrupted;

an electronic circuit comprised of a means to extend the time period within which the door may be opened without activation of the alarm means by again pressing the actuable switch; and an electronic circuit comprised of a means to allow the actuable switch to be pressed before or after the door is opened to avoid activation of the alarm means.

7. The alarm system of claim 6 further comprising an electronic circuit with a means to activate the alarm means with a chirping sound for an extended period of time when the energy of the power source is low.

8. The alarm system of claim 6 wherein the proximity switch comprises a magnetic reed switch.

9. The alarm system of claim 6 wherein the electrical power source comprises a battery.

* * * * *